United States Patent [19]

Dillon et al.

[11] 4,455,354

[45] Jun. 19, 1984

[54] DIMENSIONALLY-CONTROLLED COBALT-CONTAINING PRECISION MOLDED METAL ARTICLE

[75] Inventors: Kenneth R. Dillon; Richard L. Terchek, both of White Bear Lake, Minn.

[73] Assignee: Minnesota Mining and Manufacturing Company, St. Paul, Minn.

[21] Appl. No.: 207,196

[22] Filed: Nov. 14, 1980

[51] Int. Cl.[3] ..... B22F 3/26

[52] U.S. Cl. ..... 428/568; 428/567; 419/17; 419/27

[58] Field of Search ..... 428/567, 568, 569; 75/203, 204, 208 R; 419/27, 17

[56] References Cited

U.S. PATENT DOCUMENTS

| | | | |
|---|---|---|---|
| 2,791,025 | 5/1957 | Ballhausen et al. | 75/203 |
| 3,149,011 | 9/1964 | Smiley et al. | 75/204 |
| 3,459,547 | 8/1969 | Andreotti et al. | 75/208 R |
| 3,480,410 | 11/1969 | Hummer | 75/203 |
| 3,551,991 | 1/1971 | Reich et al. | 75/204 |
| 3,708,281 | 1/1973 | Andreotti et al. | 428/568 |
| 3,779,715 | 12/1973 | Wendler et al. | 428/567 |
| 4,113,480 | 9/1978 | Rivers | 75/214 |
| 4,314,399 | 2/1982 | Severinsson | 75/229 |

FOREIGN PATENT DOCUMENTS

| | | | |
|---|---|---|---|
| 0476405 | 8/1951 | Canada | 428/567 |
| 2005728 | 4/1979 | United Kingdom . | |

OTHER PUBLICATIONS

"INCO Nickel Powders, Properties and Uses", 11, (International Nickel Company, Inc., 1975).

Snape, "Infiltration of Iron Compacts with Ni-Containing Copper Infiltrants", *Powder Metallurgy International,* 6, 1, pp. 20–22, (1974).

McGeary; R. K., *J. Am. Ceram. Soc.,* 49, 513–22, (1962).

*Primary Examiner*—Brooks H. Hunt

*Attorney, Agent, or Firm*—Donald M. Sell; James A. Smith; David R. Cleveland

[57] ABSTRACT

The shrinkage normally encountered when molding a mixture of spherical cobalt-containing particles and thermoplastic binder, heating the resulting molded article to degrade the binder and form a porous preform, and infiltrating the same is counteracted by adding finely divided elemental iron or elemental nickel to the spherical cobalt-containing particles. In addition to improving dimensional control, the elemental powder addition increases impact strength while maintaining hardness.

14 Claims, 7 Drawing Figures

DIMENSIONALLY-CONTROLLED COBALT-CONTAINING PRECISION MOLDED METAL ARTICLE

TECHNICAL FIELD

This invention relates to powder metallurgy. In addition, this invention relates to precision molded metal articles such as tools and die cavities. Also, this invention relates to a process for preparing replicated metal articles from a handleable, unconfined, cobalt-containing molded preform while reducing or eliminating dimensional change during processing thereof.

BACKGROUND ART

As a result of demand for metal parts with complex shapes and stringent mechanical property requirements, fabricators have sought to make many parts by powder metallurgy processes. Attainment of necessary dimensional control can be difficult in such processes, especially when making large parts.

United Kingdom Published Patent Specification No. 2,005,728 A describes a particularly useful powder metallurgy process for making precision parts from spherical non-refractory metal powders by molding in a flexible mold a plastic mixture of such powders and heat-fugitive binder comprising thermoplastic material to form a green article of predetermined shape and dimensions, heating the green article to remove the binder and consolidate the non-refractory spherical powders in the form of a porous, monolithic skeleton of necked particles of non-refractory metal, infiltrating the skeleton with a molten metal having a melting point that is at least 25° C. less than the melting point of the lowest melting of said spherical, non-refractory metal powders, and cooling the infiltrated skeleton, thereby forming a homogeneous, void-free, non-refractory metal article of two intermeshed metal matrices. In practice, cobalt alloy-containing spherical non-refractory metal powders have proven themselves especially useful in such process because articles made from such powders have greater wear and corrosion resistance than iron-base articles made according to the same process and hardened to an equivalent hardness level.

Articles produced according to the process described in said patent specification have very low dimensional change during processing. With adjustment of the size of the master, a precision tolerance from blueprint specification of better than ±0.2% can be obtained with said process. Included among the examples in said patent specification are articles (made without adjustment of the master) having shrinkage of between 0.40% and 1.98% based on a comparison of the dimensions of the green molded article and the infiltrated final article. Also included among the examples in said patent specification are articles having shrinkage of between 0.25% and 0.32% based on a comparison of the dimensions of the lightly sintered skeletal preform and the infiltrated final article.

The dimensions of hard metal parts such as tools and die cavities are generally specified in the trade on an absolute basis (e.g., as plus or minus a specific lineal dimension) rather than being specified on a relative basis (e.g., as plus or minus a specific percentage of total lineal dimension). Therefore, a powder metallurgy process which results in even very low dimensional change on a relative basis may be unacceptable for use in the manufacture of large precision parts because the extent of dimensional change encountered during processing of such parts using powder metallurgy techniques may exceed the required lineal tolerance for such parts. Also, when articles having unequal length and width are prepared, dimensional change during processing can lead to anisotropic lineal shrinkage, thereby rendering it difficult to accurately replicate such articles using powder metallurgy processes. Accordingly, it is always desirable to reduce the extent of dimensional change in a powder metallurgy process because such reduction in dimensional change may thereby enable the processing of large parts, or parts with unequal length and width, while remaining within specified lineal dimensional tolerances.

Shrinkage is the most common form of dimensional change occurring during processing of precision molded articles using the method described in said U.K. Patent Specification. In conventional compressed powder metallurgy compaction processes, a variety of types of metal powder additives have been added to the powder compact in order to further densify the compact. Because an increase in densification of a powder metallurgical article represents a form of shrinkage, the use of such metal powder additives in the process of said patent specification would not be expected to result in shrinkage retardation or expansion.

Carbonyl nickel is a powdered, finely divided metal which has been utilized in conventional compressed powder metallurgy compacts to promote densification thereof, see "INCO Nickel Powders, Properties and Uses", 11 (International Nickel Company, Inc., 1975). Carbonyl nickel powder has also been reported as an infiltrant additive in the processing of iron compacts using conventional compressed powder metallurgy techniques, see Snape, "Infiltration of Iron Compacts with Ni-Containing Copper Infiltrants", *Powder Metallurgy International,* 6, 1, pp. 20–22 (1974) and U.S. Pat. Nos. 3,459,547 and 3,708,281 to Andreotti et al. Snape infiltrated an iron compact with copper and observed that expansion occurred during infiltration. Addition of carbonyl nickel powder to the infiltrant reduced the expansion, thereby providing a compensatory shrinkage. The nickel-containing infiltrated iron compact described by Snape had increased yield strength but decreased elongation compared to an iron compact made without carbonyl nickel powder addition to the infiltrant. After heat treating, yield strength increased and elongation decreased for iron compacts prepared with or without a carbonyl nickel powder addition to the infiltrant.

DISCLOSURE OF INVENTION

The present invention provides, in one aspect, a shaped, homogeneous, monolithic metal article, comprising:

A. a skeleton, comprising (i) a plurality of generally spherical domains having an average diameter less than about 200 micrometers, said domains, when viewed using backscattered electron imaging, comprising granules of chromium carbide homogeneously dispersed throughout a first solid solution comprising cobalt and chromium;

(ii) a second solid solution comprising cobalt and chromium, said second solid solution (a) containing a greater percentage of cobalt and a lesser percentage of chromium than said first solid solution, (b) being essentially free of carbides, and (c) enveloping the majority of said spherical domains, the so-enveloped domains and second solid solution being interconnected to form said skeleton; and (iii) iron or nickel as an additional component of said first and second solid solutions; and B. infiltrant, comprising a continuous phase of metal or alloy occupying the volume of said article not occupied by said skeleton;

said skeleton and said infiltrant thereby comprising two intermeshed matrices and said article being substantially void-free.

The present invention also provides precision molded tools and die cavities containing such compositions.

In addition, the present invention provides in a process for making infiltrated molded metal articles by molding in a flexible mold of a master a plastic mixture of spherical cobalt-containing powder and heat-fugitive binder comprising thermoplastic material to form a green article of predetermined shape and dimensions, removing said green article from said mold, heating said green article to remove said binder and consolidate said cobalt-containing spherical powder in the form of a porous, monolithic skeleton of particles of cobalt-containing metal, infiltrating said skeleton with a molten metal having a melting point that is at least 25° C. less than the melting point of the lowest-melting of said cobalt-containing metal particles, and cooling the infiltrated skeleton, the improvement comprising mixing with said spherical, cobalt-containing powder up to about 11% by weight, based on the weight of said spherical, cobalt-containing powder, of elemental iron or elemental nickel particles having an average particle diameter less than about 10 micrometers.

The process of this invention results in extremely low or even zero dimensional change between the master and the final infiltrated article. Thus, precision molded articles can be replicated with the dimensional fidelity necessary to meet stringent tolerances.

BRIEF DESCRIPTION OF DRAWING

In the accompanying drawing.

DETAILED DESCRIPTION

Figure 1:
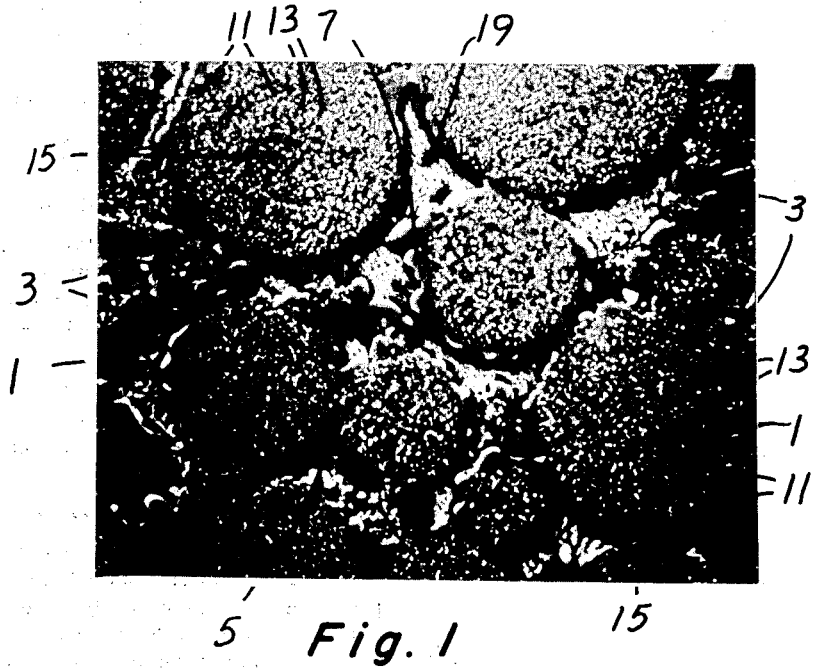
FIGS. 1 and 2 are scanning electron micrographs at magnifications of 1500X and 5000X, respectively, of a polished and etched section through an article of this invention made with a 3% elemental carbon-bearing iron addition.

In the practice of this invention, finely divided iron or nickel particles (preferably carbonyl iron or carbonyl nickel particles), having an average particle diameter less than about 10 micrometers, are mixed with cobalt-containing spherical powders and processed to form an infiltrated article. Such iron or nickel particle additions result in shrinkage retardation or expansion during sintering or infiltration of the skeletal preforms containing such spherical powders, thereby countering the shrinkage which would otherwise normally occur in the absence of said iron or nickel particle addition. Because ordinarily the addition of finely divided carbonyl nickel powder to a conventional powder metallurgy compact results in densification (i.e., shrinkage) thereof, the expansion observed in the present invention represents an unexpected result.

As an added benefit of the present invention, addition of carbon-bearing carbonyl iron particles to such spherical powders can maintain the hardness of such articles while increasing the impact strength thereof. Because ordinarily an increase in impact strength is achieved at the expense of a loss in hardness (and vice versa), an increase in impact strength as a result of such addition of carbon-bearing carbonyl iron particles without loss of hardness, represents a further unexpected result.

The process employed to make the articles of this invention can be described as follows. A replicating master of the desired shape and size is used to prepare a flexible rubber mold. Next, spherical particles of cobalt-containing metal are mixed with finely divided particles of elemental iron or nickel having a particle diameter less than about 10 micrometers (such finely divided iron or nickel particles being hereafter referred to collectively as "elemental particles"). The resulting powder mixture is mixed with a heat-fugitive binder and the powder-binder mixture is then placed in the flexible mold and thereby molded into a shape that is the same as the desired final shape. The powder-binder mixture is cured or solidified in the flexible mold and the resulting cured, molded "green" article is demolded and heated to thermally degrade and remove essentially all of the binder and lightly sinter together the metal particles of the green article to yield a shape stable, handleable, porous molded shape or "preform". The preform is then infiltrated at a temperature below the melting point of said spherical particles with an infiltrant. After infiltration, the infiltrated article is optionally heat treated to improve its physical properties. The dimensions of the infiltrated article are compared to the dimensions of the master. If a difference in the dimensions of the infiltrated article and those of the master is noted, the amount of elemental particle addition can be altered, thereby enabling replication of subsequent infiltrated articles having dimensions closer to that of the master. The addition of elemental particles causes a generally linear shrink reduction or expansion in the dimensions of the final infiltrated article (compared to an article made without such elemental particle addition), and additions of less than about 11 percent by weight of elemental particles (compared to the total weight of elemental particles and spherical particles) are generally sufficient to compensate for the ordinarily observed shrinkage in processing of infiltrated articles made without such elemental particle addition. Therefore, infiltrated articles can be prepared according to the present invention with extremely low or even zero shrinkage between master and final infiltrated article, without the need for compensatory adjustment of the size of the master.

The spherical cobalt-containing particles used in this invention are well known in the art, although such particles are not commonly used in powder metallurgy part-making processes other than that of the aforementioned U.K. Published Patent Specification, due to the low green strength of compacts prepared from spherical particles. Such spherical particles are described in U.S. Pat. No. 4,113,480. It should be noted that said patent describes a powder metallurgy part-making process using such spherical particles, but such process employs sintering of the cobalt-containing particles to a "dense state", thereby resulting in substantial process shrinkage.

"Spherical" as used herein means essentially spherical and is inclusive of spheroidal, oblate, or prolate. During heating and infiltrating of the articles of this invention, minor changes in shape of individual particles may occur. Minor deviations from precise sphericity which are due to original particle shape or heat-induced changes in particle shape do not adversely affect the use of such particles in this invention. Typically, such spherical particles contain alloying elements including chromium, molybdenum, tungsten, carbon, silicon, boron, and combinations thereof. Commercially available cobalt-containing spherical particles or powders which can be used in this invention include alloys no. 1, 21, and 157 sold by Cabot Corp. under the "Stellite" trademark, and Special Metals Corporation's Co-6 alloy sold under the "Vertex" trademark. These commercially available powders generally exhibit a mono-modal size distribution curve (by weight) and contain a mixture of fractions of small particle sizes and fractions of larger particle sizes. Because of their commercial availability, these mono-modal powders are preferred in the practice of this invention and the properties of the molded articles of this invention can be achieved without requiring the use of multi-modal powders. Mixtures of such commercially available powders can also be used in the practice of this invention. The size of the spherical cobalt-containing metal particles in such powders is a broad distribution of about 1 to 200 micrometers diameter, with particles having 1 to 44 micrometers diameter being preferred. The use of finer spherical particles as opposed to coarser spherical particles generally results in formation of infiltrated parts having better surface finish. Commercially available spherical cobalt-containing powders can contain a small proportion of particles with a diameter of less than 1 micrometer. Such small diameter particles may increase the observed processing shrinkage; their presence will not adversely affect this invention as long as any shrinkage caused thereby can be compensated for by elemental particle addition. The calculated surface area of spherical cobalt-containing particles falling within the size range preferred in the practice of this invention is about $1.8\times10^{-2}$ $m^2/g$ to $14.2\times10^{-2}$ $m^2/g$ and most preferably is about $4\times10^{-2}$ $m^2/g$ to $8\times10^{-2}$ $m^2/g$.

The desired surface geometrics of the infiltrated molded article will be a principal factor in determining the particle size and size distribution of spherical particles to be used in making such articles. If intricate detail or high surface finish is desired, the particle size distribution chosen will have a larger proportion of small diameter spherical particles; conversely, if little detail or a rough surface finish is required, a distribution with a larger proportion of large diameter spherical particles may be employed.

The volume of the infiltrated article to be occupied by the skeleton derived from the spherical cobalt-containing particles and elemental particles will also determine the particle size and size distribution of spherical cobalt-containing particles chosen. The infiltrated article will contain as the major portion thereof lightly sintered spherical cobalt-containing particles and elemental particles, with at least 60 volume percent preferably, (and more preferably, at least 65 volume percent) and not in excess of about 80 volume percent spherical cobalt-containing particles. The volume percent of the article occupied by spherical cobalt-containing particles is controlled by the degree of loading of the organic binder and the extent of elemental particle addition. Variation of particle size and size distribution to adjust the loading is known in the art, e.g., see R. K. McGeary, *J. Am. Ceram. Soc.*, 44, 513–22 (1961).

The elemental particles used in the present invention have a relatively small average particle diameter (viz., less than about 10 micrometers). Preferably such elemental particles have an average particle diameter between about 3 and about 5 micrometers. Although elemental metal particles having such particle size characteristics could be prepared by grinding and classifying of elemental iron or nickel, they are more conveniently obtained as commercial powders made by the carbonyl process. Carbonyl iron and carbonyl nickel particles are therefore preferred elemental particles for use in this invention. Carbonyl iron and carbonyl nickel particles will be referred to hereafter collectively as "carbonyl particles". The use of small diameter elemental particles enables such particles to occupy the interstices between spherical cobalt-containing particles, contributing to maintenance of shape stability and dimensional fidelity during subsequent sintering of preforms containing such elemental particles and spherical particles.

Elemental iron and nickel particles for use in the present invention can have regular or irregular shapes. Such elemental particles need not be spherical, but can be equiaxed, chain-like, filamentary, or platelike. Commercially available carbonyl particles for use in this invention are well known and include types "TH" and "HP" iron powders sold by General Aniline and Film Co., and type "123" nickel powder sold by International Nickel Company, Inc. Preferably, carbonyl iron particles are used in this invention. In addition, where such carbonyl iron particles are used, it is preferred that such particles contain residual carbon, that is that they be of the "carbon-bearing" type. A preferred commercially available carbon-bearing carbonyl iron powder is type "TH" powder, the particles of which contain about 0.8% carbon. The carbonyl iron particles in type "TH" powder have an average particle diameter between about 3 and 5 micrometers.

The amount of elemental particles to be added to the cobalt-containing spherical particles ordinarily is an amount sufficient to minimize dimensional change of the molded article during processing. However, because the amount of elemental particles added also affects the ultimate physical properties of the final infiltrated article, the amount of elemental particle addition can be chosen based on the desired final properties rather than the desired dimensional change during processing. In general, elemental particle additions of between about 3 and 15% are preferred, with elemental particle additions of about 3 to about 11% being most preferred. Elemental particle additions of about 3 to 7% give a good balance of dimensional control and physical property improvement in articles made from commercial 1–44 micrometer diameter spherical cobalt-containing particles.

The addition of elemental particles to the spherical cobalt-containing particles results in an increase in volume loading of the powder mixture in organic binder compared to the use of spherical cobalt-containing particles alone. Also, addition of elemental particles to such spherical cobalt-containing particles reduces average observed shrinkage during processing of the green molded article to the fired skeletal preform, and at sufficiently high elemental particle additions may result in observed expansion rather than observed shrinkage as the green molded article is processed to form a fired skeletal preform.

During the handling and mixing of the spherical cobalt-containing particles and elemental iron or nickel particles, and during subsequent processing thereof, care should be taken to avoid introduction of contaminants (e.g., oxides) into the powder mixture. Such contaminants can be reduced during sintering and infiltration of the skeletal preform containing such powder mixture, thereby causing undesirable dimensional changes in the preform or in the final infiltrated article.

Organic binders suitable for use in this invention are those which melt or soften at low temperatures, e.g., less than 180° C., preferably less than 120° C., thereby providing the metal powder-organic binder mixture with good flow properties when warmed and yet allow the powder-binder mixture to be solid at room temperature so that a green article molded therefrom can be normally easily handled without collapse or deformation. The binders used in this invention are those which are heat-fugitive, that is, which burn off or volatilize when the green article is heated without causing internal pressures in the resulting skeletal article due to binder vaporization and without leaving significant binder residue in the skeletal article resulting from such heating step.

Organic thermoplastics, or mixtures of organic thermoplastics with organic thermosets, are mixed with the spherical cobalt-containing metal particles and elemental particles to form a moldable paste-like or plastic mass when the resulting binder-powder mixture is heated. Examples of thermoplastic binders include paraffin, e.g., "Gulf Wax" (household grade refined paraffin), a combination of paraffin with a low molecular weight polyethylene, mixtures of stearic acid and oleic acid, oleic acid, stearic acid, lower alkyl esters of oleic acid, lower alkyl esters of stearic acid, polyethylene glycol esters of oleic acid, polyethylene glycol esters of stearic acid, e.g., "Emerest" 2642 (polyethylene glycol distearate, average molecular weight of 400), other waxy and paraffinic substances having the softening and flow characteristics of paraffin, and mixtures thereof. "Emerest" is a preferred thermoplastic binder because it is absorbed by a flexible silicone rubber mold to a lesser degree than many other thermoplastics.

Representative thermosetting materials which can be used in combination with thermoplastics as binders include epoxide resins, e.g., diglycidyl ethers of bisphenol A such as 2,2-bis[p-(2,3-epoxypropoxy)phenyl]propane, which can be used with appropriate curing catalysts. Care must be exercised so as not to thermally induce cross-linking during the mixing and molding steps which thermoplastic-thermoset mixtures are used as binders. Once the thermoplastic-thermoset binder mixture and the metal powder mixture have been placed in the warmed mold and vibrated, curing may be initiated by further warming the mold. Thermoplastic-thermoset binder mixtures tend to produce green articles that have higher green strength and thus are more handleable than green articles made with just a thermoplastic as the binder. Also, thermoplastic-thermoset binder mixtures can be processed without obtaining solidification shrinkage, while the use of a thermoplastic binder such as "Emerest" 2642 alone generally leads to minor lineal solidification shrinkage. Preferably the thermoplastic binder in such thermoplastic-thermoset binder mixtures is a low molecular weight thermoplastic material or mixture of such materials, in order to provide stepwise degradation of the binder components and orderly removal of the binder from the green molded article during firing thereof. "Carbowax" 200 is a preferred thermoplastic binder for use in such thermoplastic-thermoset binder mixtures. Also, the thermoplastic-thermoset binder mixture preferably contains a diluent which is a good solvent for the uncured binder but a poor solvent for the cured binder. The diluent should be minimally absorbed by the flexible molding material in which the powder-binder mixture is placed. Also, the diluent should have a sufficiently high boiling point so that it does not boil away before curing or setting of the binder, and a sufficiently low boiling point so that the diluent volatilizes before any components in the binder begin to thermally degrade. Preferred diluents are those which volatilize at temperatures of about 150° C. to 210° C., such as low molecular weight polyoxyglycol and light hydrocarbon oils. A preferred diluent is 1,3-butanediol (B.P. 204° C.).

A useful thermoplastic-thermoset binder mixture can be made from 29.6 parts "Epon" 825 bisphenol-A epoxy resin, 9.1 parts "Epi-cure" 872 polyamine curing agent, 29.25 parts of "Carbowax" 200 polyethylene glycol, and 35.75 parts 1,3-butanediol. This binder should be heated to about 40° C. in order to provide adequate flow of the binder-metal powder mixture during filling of the mold. As the ratio of resin to the total amount of thermoplastic plus diluent decreases, binder flow increases, metal powder loading increases, deairing of the binder-metal powder mixture becomes easier, and there is less tendency for the molded part to crack or blister during binder degradation. However, as such ratio decreases, green part rigidity and green-state dimensional stability generally decreases. Therefore, the amounts of components given above may have to be empirically adjusted to optimize production of a given part shape or size.

The metal powder mixture and organic binder are preferably mixed in a warmed blending device, e.g., a sigma blade mixer, the temperature being sufficiently high to promote good flow of the organic binder thereby allowing the powders and binder to be homogeneously mixed. Any order of addition of spherical cobalt-containing particles, elemental particles, and binder can be used. The particular amount of binder used depends upon the particle size and size distribution of particles employed. Sufficient binder should be used, e.g., 2 to 10 parts by weight if 100 parts metal powders are employed, such as will permit the mixture of powders to flow into and optimally occupy the mold. The powder-binder mixture is warmed to form a plastic mass and directly transferred into a flexible mold.

In order to provide a mold for molding the warm plastic mass into a desired shape, a pattern or replica is made from a master. The master can be made in a conventional manner from wood, plastic, metal, or other machinable or formable material. A molding material is poured around the master in a suitable container, the molding material cured, and the master withdrawn to form a mold which is capable of reproducing substantially identical copies of the master, including fine details and cross sections, in accordance with this invention.

The metal articles produced in the practice of this invention can have a working surface (that is, the working portion) that comes into contact with and effectuates a deformation in a material to be worked, and a support portion that maintains the working surface in the proper position to produce the desired deformation. For example, a core pin, produced according to this invention, can be used to form a hole in an injection molded plastic part. The working surface of such a core pin is that portion that actually comes into contact with the plastic material to be molded and the support portion holds the core pin in position so that the desired hole is produced.

The preferred master has the working surface and support portion mounted on and extending out of or away from a base. The base may be the remainder of the material from which the working surface-support portion was produced, or the working surface-support portion may be mounted on a separate base after production. If the preferred master is used, then in the later light sintering step a one-piece porous metal skeleton will be produced having a working surface-support portion mounted on a base. This is desirable because the metal skeleton so produced may be infiltrated by passing the infiltrant metal through the base prior to entry of the infiltrant into the remainder of the porous metal skeleton. Infiltrating the metal skeleton through the base permits the infiltrate to solubilize, i.e., to become enriched with the metals of which the working surface-support portion is composed, prior to infiltrating the remainder of the skeleton. Such enrichment of the infiltrant metal reduces dimensional changes that would occur if the body of the skeleton were to be infiltrated with unenriched infiltrant metal and the skeleton metal were to become significantly solubilized in this unenriched infiltrant. After infiltration, the base may be completely removed or machined to a desired configuration to be used as the support portion for the working surface. In this latter instance, the base functions as both the support portion and base and therefore the working surface may be mounted directly on the base.

The molding materials which can be used in the practice of this invention are those which cure to an elastic or flexible rubbery form and generally have a Shore A durometer value of about 25–60, and reproduce the fine details of the master part without significant dimensional change, e.g., without more than 0.5 percent linear change from the master, and preferably with essentially zero linear change. The molding materials should not be degraded when heated to molding temperatures, e.g., 180° C., and should have a low cure temperature, e.g., room temperature. A low temperature curing molding material will form a mold which maintains close dimensional control from master to mold. A high temperature curing molding material will generally produce a mold having dimensions substantially different from those of the master. To maintain dimensional control, it is preferable that the mold material have a low sensitivity to moisture. Examples of suitable molding materials are curable silicone rubbers, such as those described in Bulletin "RTV" 08-347 of Jan., 1969, of the Dow Corning Co., and low exotherm urethane resins. Such molding materials cure to an elastic or rubbery form having a low post cure shrinkage. The molding material can be optionally reinforced by the addition of about 30 volume percent of less than 44 micrometer glass beads, as such reinforcement can provide improved dimensional control in the molding process, particularly in the molding of parts having a volume greater than about 450 $cm^3$.

The amount of molding material used to form a mold of the master can vary depending on the particular molding material used and the shape of the master. It has been found that about 10–14 $cm^3$ of molding material for each cubic centimeter of the master will form a mold which retains the desired flexible properties and also has sufficient strength to resist the small hydrostatic head produced by the plastic powder-binder mass in the mold before solidification of the binder.

The molding conditions for molding the articles of this invention permit the use of an inexpensive soft, elastic or rubbery mold because the only pressure applied is the hydrostatic head of the plastic powder-binder mixture in the mold, which pressure is much less than that used in conventional powder metallurgy compaction. The mild molding conditions thus help ensure a precisely molded green article even though a highly deformable mold is used. In addition, the molding technique results in a molded green article with a uniform density because of the advantageous flow characteristics of the spherical powder.

The powder-binder mixture, warmed 10° C. to 20° C. or more above the softening point of the thermoplastic binder component, can be fed into the vibrating elastic mold that has been preheated to approximately the same temperature as the powder-binder mixture, and the mold and its contents can then be evacuated. By choosing the proper size distribution of metal particles and a suitable organic binder, the consistency of the powder-binder mixture is such that the mixture can be molded with only slight vibration to ensure removal of air pockets or gas bubbles.

After filling the warmed, evacuated mold, vibration of the mold is discontinued and the mold is isothermed, e.g., maintained at a constant temperature 10° C. to 30° C. above the softening point of the binder (for a thermoplastic binder) or maintained at the thermal cure temperature (for a binder containing thermoset resin), for about 1 to 24 hours. The mold and its contents are vibrated for a short period during such isotherm to bring the mold and the green molded part into dimensional conformity.

If the binder is a thermoplastic which melts at a fairly low temperature, e.g., 35° C. to 40° C., then it is necessary to cool the mold and its contents to the point where the binder becomes fairly rigid (e.g., to 0° C. to 5° C.) to demold the green molded part, preferably in a desiccator to reduce moisture condensation. If the binder contains thermoset resin, then such cooling is not required and the green molded part can be demolded at the isotherm temperature. The solid green article can be easily demolded by application of a vacuum to the exterior of the flexible mold. Vacuum demolding allows easy demolding of shapes that have undercuts. The resulting, demolded, green article is a faithful replica of the master. This molded article has a good green strength due to the hardened matrix of organic binder supporting the spherical cobalt-containing particles and elemental particles. The metal particles are homogeneously dispersed in the organic binder matrix, conducive to forming a green article with uniform density (because of the uniform distribution of powder within the binder) and to forming a skeleton therefrom with corresponding uniform porosity when the binder is removed.

The uniform density of the green molded article is important in the subsequent firing and infiltration steps. A uniform green density will minimize or prevent shape distortions when the green molded article is heated and infiltrated. Also, a uniform density will minimize or prevent the formation of localized pockets of infiltrant metal which otherwise would make the ultimate finished article exhibit unstable and non-uniform electrical or physical properties.

To form the skeletal preform, the green molded article is preferably packed in a gently vibrating bed of non-reactive refractory powder, e.g., alumina, to prevent sagging and loss of dimension upon heating in a programmable furnace to a temperature of about 900° C. to 1150° C. Heating the molded green article removes the organic binder and lightly sinters or tacks the metal powder mixture together to form a metallurgically integral, handleable, porous, monolithic article or skeleton. The term "metallurgically integral" as used herein means that there is a solid state interatomic diffusion, i.e., there is a solid state bond formed between the various metal particles of the skeleton.

Programmed heating is preferably employed during binder degradation and binder removal so as to cause only minimal shrinkage of the preform. Programmed heating avoids the excessive shrinkage that would occur if higher temperatures or longer sintering times were used, thereby resulting in increased surface and volume diffusion of the particles of the skeleton, and a reduction in porosity and increase in density thereof. Programmed heating also avoids the introduction of internal and external cracks otherwise produced by rapid evolution of gaseous binder degradation products if the green molded article were to be rapidly heated to the light sintering temperature. Small green molded articles are generally capable of being heated at a more rapid rate than larger articles. A heating schedule found suitable for articles as large as 125 $cm^3$ when, for example, polyethylene glycol distearate is used for the organic binder, is as follows:

Step 1 from room temperature to 200° C. (about 43° C. per hour)

Step 2 from 250° C. to 400° C. (about 7.5° C. per hour)

Step 3 from 400° C. to the light sintering temperature (about 100° C. per hour).

This programmed heating is carried out under a protective atmosphere, e.g., hydrogen-argon, hydrogen, argon, or other neutral or reducing atmospheres known in the powder metallurgy art to prevent oxidation of the metal particles.

Heating the green molded article to a temperature in excess of about 1050° C. when alumina is used as the refractory non-reactive support material may cause some alumina to adhere to the green molded article. For this reason, when a final light sinter temperature in excess of about 1050° C. is intended, the light sintering process may be stopped at about 1050° C. and the resulting coherent, handleable molded article can be cooled and removed from the alumina bed. Alumina adhering to the surface of the article is gently removed and the article heated to the desired final light sintering temperature without the necessity of support in non-reactive refractory powder. Where light sintering temperatures of less than about 1050° C. are employed, surface adhering support material can be removed by gentle brushing with a camel's hair brush.

To ensure complete filling of the interstitial pore volume a mass of infiltrant metal in excess of the calculated interstitial pore volume can be used. However, in such instance excessive wetting of the skeleton and accumulation of buildup of the infiltrant on the exterior surface of the article ("blooming") often will result. Excessive skeleton wetting can be minimized by using slightly less infiltrant than necessary to completely fill the voids of the metal skeleton, but this will leave uninfiltrated voids in the final composite and thereby reduce its mechanical strength and uniformity of electrical and physical properties.

Surface blooming can be reduced or prevented in this invention by coating the exterior surface of the lightly sintered metal skeleton with a thin layer of zirconia powder, e.g., by lightly spraying the exterior of the metal skeleton with a suspension of zirconia powder in a readily evaporated or volatilized carrier, e.g., acetone. The zirconia powder coating reduces surface buildup of the infiltrant and permits the use of a mass of infiltrant metal in excess of that necessary to just fill the interstices of the metal skeleton without the occurrence of blooming (or uninfiltrated voids). Contact between those exterior areas of the skeleton where infiltration is to occur, e.g., the base, and the zirconia powder is to be carefully avoided, e.g., by covering such areas with masking tape. The zirconia coating step may be used selectively or eliminated if some amount of surface blooming is desired, e.g., to produce a molded article that appears as though it was formulated completely from the infiltrant metal, e.g., a decorative art object with a cobalt alloy metal skeleton infiltrated with silver or a silver alloy.

The porous metal skeleton (preferably zirconia-treated as described above) is infiltrated or infused with a metal or alloy that melts at a temperature below the lowest melting cobalt-containing spherical powder of which the metal skeleton is composed. Preferably such infiltrant has the properties discussed below. When the infiltrant melting point ($M.P._i$) and the melting point of the lowest melting spherical cobalt-containing particles of the skeleton (M.P.sp) are both expressed in degrees Kelvin, workable $M.P._i/M.P._{sp}$ ratios of as high as 0.98, with 0.95 or less being preferred, can be used. As this ratio decreases dimensional changes also decrease, which means the lower limit of the infiltrant metal melting point-skeleton metal melting point ratio is determined by the desired properties of the final infiltrated articles.

Infiltrants with the preferred properties discussed below generally have melting points greater than about 700° Kelvin and therefore the lower limit of the melting point ratio is about 0.5 with 0.6 being preferred. Preferably the melting point of the infiltrant is below about 1050° C., in order to minimize dimensional change during heating and infiltration of the articles of this invention.

Infiltration of the metal skeleton occurs uniformly by capillary action without pressure applied to the infiltrant and without the formation of localized pools of infiltrant material in the skeleton. Because the infiltrant is uniformly distributed throughout the skeleton body, uniform strength and acceptable electrical characteristics are obtained, with minimal shape distortion of the final infiltrated object. The metal skeleton can be supported on a bed of refractory, non-reactive powder.

The bed is arranged so that the solid infiltrant material (which may be in the form of powder, shot, or bars) is either in direct contact with the metallic skeleton or not in such contact but flowable under the influence of gravity toward that area of the metal skeleton through which infiltration is to occur. While liquified, the infiltrant enters the skeleton by capillary action. Direct contact between some solid infiltrant materials (e.g., copper/nickel/tin alloy containing 15 weight percent nickel and 12 weight percent tin) and the metallic skeleton can cause bonding of the two during heating. In addition, differences in the thermal coefficients of expansion or sintering rate between some infiltrants and the skeleton can cause stress and possible cracking of the base of the skeleton. No contact between the solid infiltrant and the metal skeleton is therefore preferred for some infiltrants.

The metal infiltrant used will be chosen to suit the end use for the finished part. When an electrical discharge machining electrode is desired, infiltrants having good electrical conductivity, e.g., copper, silver, and alloys of these metals, can be used. Where a harder or stronger finished article is desired, e.g., as for structural parts, the infiltrant material can be composed of hardenable alloys which can be further treated to increase the hardness and strength of the article. For impact-resistant parts such as molds or dies, the infiltrant can be composed of ductile alloys which impart impact-resistance to the infiltrated articles. Still other metals and alloys having a melting point below that of the skeleton can be used as infiltrants. Preferably the infiltrant does not contain high amounts of nickel (viz., the infiltrant should not contain more than about 10 to 15 weight percent nickel), as such high amounts of nickel may cause thermal stress cracking of the preform during infiltration. Also, skeletal preforms infiltrated with infiltrants containing such high amounts of nickel tend to have a gradient in nickel concentration from the base to the working surface of the final infiltrated article. Such gradient detracts from the uniform physical properties of the articles of this invention and is therefore undesirable.

The choice of infiltrant metal is preferably a metal or metals in which the spherical cobalt-containing particles are substantially insoluble. However, the elemental particles can have appreciable solubility in the infiltrant without undesirably affecting the physical properties and dimensions of the infiltrated article, as the amount of elemental particle addition is relatively small. Major solubilization of the spherical cobalt-containing particles in the infiltrant can be minimized by using an infiltrant metal that has been saturated with such cobalt-containing particles. As discussed above, solubilization can also be minimized by infiltrating the metal skeleton through a base, thereby solubilizing the skeleton metal into the infiltrant.

Additionally, the molten infiltrant metal should wet the skeleton metals in order to achieve capillary infiltration. Excess infiltrant metal in amounts greater than the calculated total interstitial pore volume can be used if the exterior of the metal skeleton has been coated with zirconia powder prior to infiltration.

The length of time at infiltration temperature and the infiltration temperature used will be a function of the size, the wetting characteristics, the amount of elemental particle addition and the interstitial pore size of the metal skeleton. At a temperature slightly above the melting point of the infiltrant, thirty minutes is usually sufficient time to infiltrate a cube-shaped skeleton with a volume as large as 130 $cm^3$.

After infiltration, the article is cooled and the exterior zirconia coating is removed, e.g., by peening with a glass bead peen apparatus (Empire Abrasive Equipment Corp. Model No. S-20) at a pressure of 1.4 to 2.8 $kg/cm_2$ using an 8 mm diameter orifice. If an age hardenable infiltrant or skeleton is employed, the infiltrated article may be subjected to a low temperature aging cycle to increase hardness and/or wear resistance. Lastly, excess infiltrant or the superfluous base is machined or cut away from the shaped composite or working surface producing the finished infiltrated molded metal article.

Sintering (and the subsequent infiltration step), and the interatomic diffusion resulting therefrom, alters the microstructure of the articles of this invention. Originally, the spherical particles contain chromium carbide granules (and optionally contain other carbide granules such as tungsten carbide granules) dispersed throughout a solid solution containing cobalt, chromium, and other alloying elements. Iron, in amounts less than 3 percent by weight of the total particle weight, is one such alloying element present in commercially available spherical cobalt-containing particles.

During binder degradation and infiltration of the articles of this invention, the elemental particles lose their original shape and coalesce to form a film or coating around a majority of the spherical cobalt-containing particles. At high levels of elemental particle addition (viz., about 7 percent or more of elemental particles based on the weight of spherical cobalt-containing particles) essentially all the spherical particles become so coated. In addition to the formation of such coating, cobalt and chromium diffuse from the solid solution of the spherical particles into the coating, thereby forming a second solid solution containing cobalt, chromium, and the elemental metal. This second solid solution is essentially carbide-free.

The elemental metal tends to diffuse into the spherical particles, into the infiltrant, or both. Nickel diffuses into copper/tin infiltrant more readily than iron will at the processing temperatures employed in this invention.

The coating containing the essentially carbide-free second solid solution and the mostly-enveloped spherical particles form an interconnected skeleton composed of coating and spherical domains. The skeleton is held together by the coating (which envelops the majority of spherical cobalt-containing particles) and by limited interparticle necking between some adjacent spherical particles. The coating tends to prevent individual spherical cobalt-containing particles from diffusing into one another and undergoing neck growth, thereby limiting process shrinkage. At high levels of elemental particle addition, net process expansion is actually observed, and in such case the elemental particle addition has apparently "pushed apart" the individual spherical cobalt-containing particles.

An optical examination of the working surface of the finished articles of this invention at a magnification of 500X reveals a discontinuous matrix of essentially spherical, non-homogeneous particles containing a dark phase with a cabbage-like appearance and a lighter phase intermeshed therewith. The majority of the spherical particles are surrounded by globules of homogeneous material in the form of an interconnected, continuous skeleton enveloping the spherical particles, with an interpenetrating continuous infiltrant phase intermeshed throughout the skeleton. No evidence of surface cold work, e.g., disturbed surface metal as produced in conventional machining operations, is seen.

Further discussion of materials and processing steps which are useful in this invention can be found in the specification and flow chart of said U.K. Patent Specification No. 2,005,728 A, incorporated herein by reference.

Referring now to the drawing, articles of this invention are shown in FIGS. 1–6. An article of the prior art (prepared according to the process of the aforementioned U.K. Patent Specification) is shown in FIG. 7. The various figures were prepared by examining under scanning electron microscope a polished and etched section of the various infiltrated articles. The etching technique used to prepare such articles was a "chemical buff" carried out by rubbing the polished section with an aqueous solution of 8.35 g $FeCl_2$ and 50 ml concentrated HCl in 100 ml water. The polished and etched sections were then carbon-coated by vacuum evaporation. The images shown in FIGS. 1–7 were obtained using a "Robinson" backscattered electron detector at an accelerating voltage of about 19KV, viewed normal to the prepared surface. The odd-numbered figures are at a magnification of 1500X, and the even-numbered figures are at a magnification of 5000X. Qualitative and quantitative elemental analyses were made using a Tracor/Northern "TN/2000" elemental X-ray analysis system.

Figure 2:
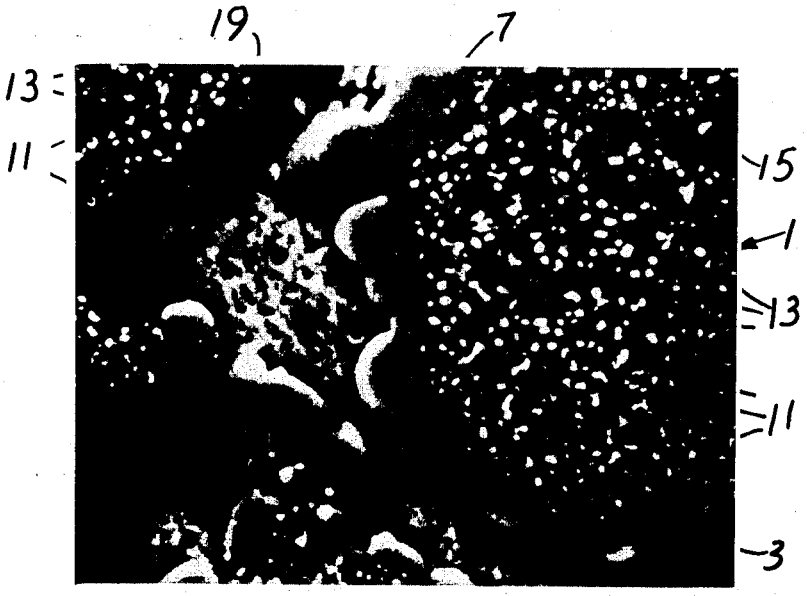

Referring now to FIGS. 1 and 2, there is shown the article of Example 1 below. Such article was made by mixing 3 weight percent carbon-bearing carbonyl iron particles with 100 weight percent spherical cobalt-containing particles. As shown in FIGS. 1 and 2, generally spherical domains 1 (derived from the spherical cobalt-containing particles) and coating 3 (derived from the carbonyl iron particles) are interconnected at their points of contact in the form of a monolithic structure or skeletal matrix. At some portions of the structure, the interconnection is manifested in the form of necks 5 which can be seen between some adjacent spherical domains. At other portions of the structure, the interconnection is manifested by coating 3 which separates adjacent individual spherical domains. Coating 3 is characterized by a gray, homogeneous appearance and is essentially free of carbides. Elemental X-ray analysis shows that coating 3 is a solid solution containing principally cobalt, chromium, iron, and tungsten in the weight ratio 66:20:9.6:4.4. Small amounts of carbon and other elements are also present in coating 3. Some parts of coating 3 contain voids 7 which are apparently a result of the original carbonyl iron particle manufacturing process.

Tungsten carbide granules 11 (light colored spots in the images) and chromium carbide granules 13 (dark colored spots in the images) are dispersed throughout spherical domains 1 of FIGS. 1 and 2. The remainder of spherical domains 1 is a solid solution 15 containing principally cobalt, chromium, iron, and tungsten, in the weight ratio 49:36:7.2:7.4. On a percentage basis there is about 33 percent more iron in coating 3 than in solid solution 15 of spherical domains 1. About 35 percent more cobalt and 44 percent less chromium are present in coating 3 than in solid solution 15. Small amounts of carbon and other elements are also present in solid solution 15.

Together, the coating and spherical domains form an interconnected, monolithic skeletal matrix. This matrix was derived from the original spherical cobalt-containing particles and carbonyl iron particles.

Intermeshed with the monolithic skeletal matrix is a matrix of infiltrant 19. Infiltrant 19 is copper/tin alloy into which some iron (from the carbonyl iron particles) has diffused during infiltration of the article.

As can be seen by inspection of FIGS. 1 and 2, the majority of the spherical domains 1 are surrounded by coating 3, and most of the carbide-bearing solid solution 15 is not directly in contact with infiltrant 19. Instead, the infiltrant principally contacts coating 3. The average thickness of coating 3, measured radially outward from individual spherical domains 1 in contact therewith, is generally less than about 5 micrometers and is usually about 1–3 micrometers.

Figure 3:
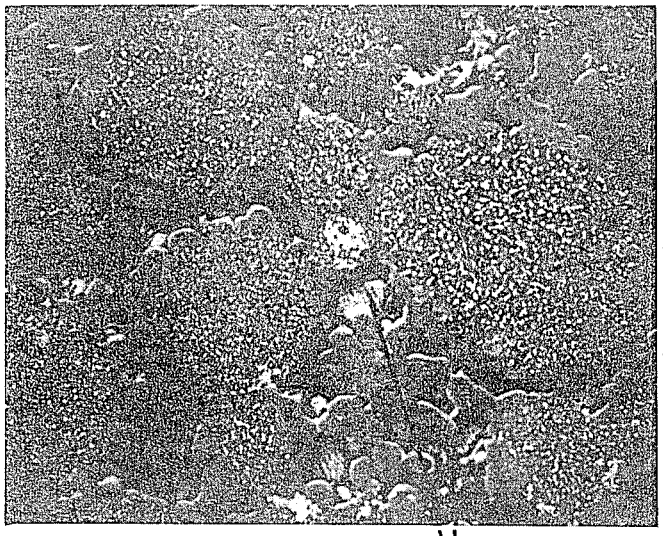
FIGS. 3 and 4 are scanning electron micrographs at magnifications of 1500X and 5000X, respectively, of a polished and etched section through an article of this invention made with an 11% elemental carbon-bearing iron addition.
Figure 4:
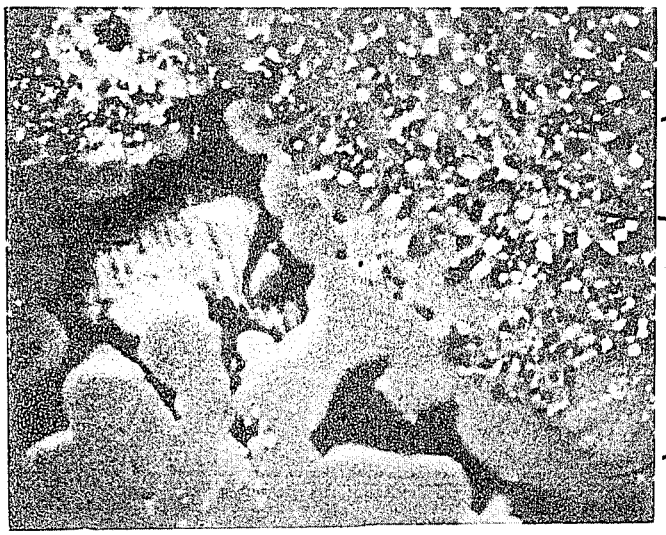

Referring now to FIGS. 3 and 4, an article of this invention prepared from an 11 weight percent addition of carbon-bearing carbonyl iron particles (based on the weight of spherical cobalt-containing particles). This article is the article of Example 3, below. The microstructure of FIGS. 3 and 4 corresponds generally to that of FIGS. 1 and 2 above, and the microstructure of FIGS. 3 and 4 has spherical domains, coating, a few interdomain necks, and infiltrant. Coating 21 is somewhat thicker and more completely envelops spherical domains 23 compared to FIGS. 1 and 2. Elemental analysis of coating 21 shows that it principally contains cobalt, chromium, tungsten, and iron, in the weight ratio 54:20:22:4. Solid solution 25 within spherical domains 23 principally contains the same elements in the weight ratio 45:32:16:6.7. Thus, about 38 percent more iron, 20 percent more cobalt, and 38 percent less chromium are present in coating 21 than in solid solution 25. Infiltrant 26 has a somewhat more mottled appearance than infiltrant 19 of FIGS. 1 and 2. This mottled appearance may be due to somewhat greater ductility of infiltrant 26 compared to infiltrant 19.

Figure 5:
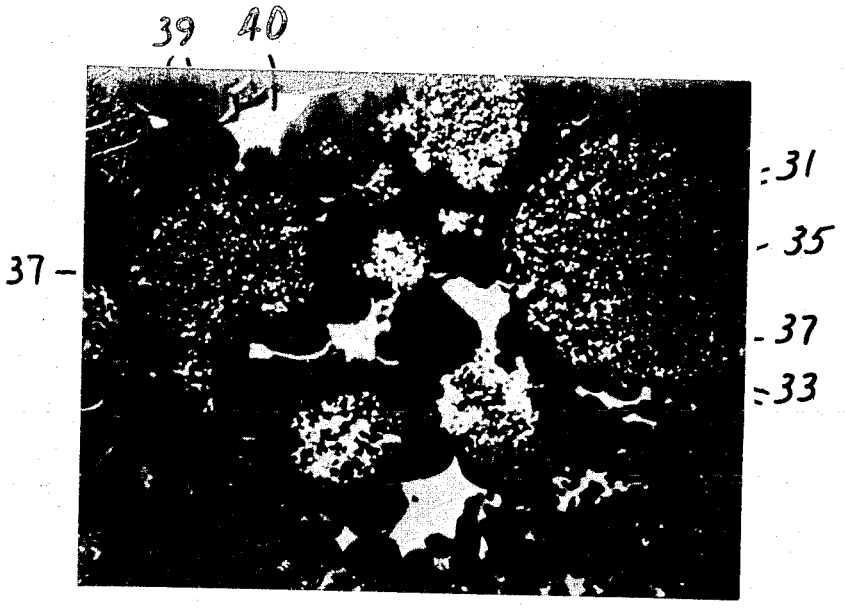
FIGS. 5 and 6 are scanning electron micrographs at magnifications of 1500X and 5000X, respectively, of a polished and etched section through an article of this invention made with an 11% elemental nickel addition.
Figure 6:
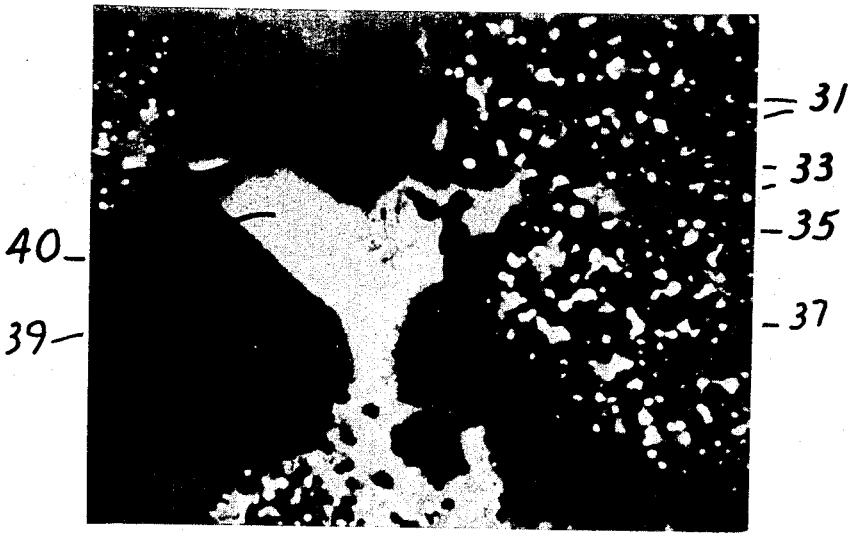
Figure 7:
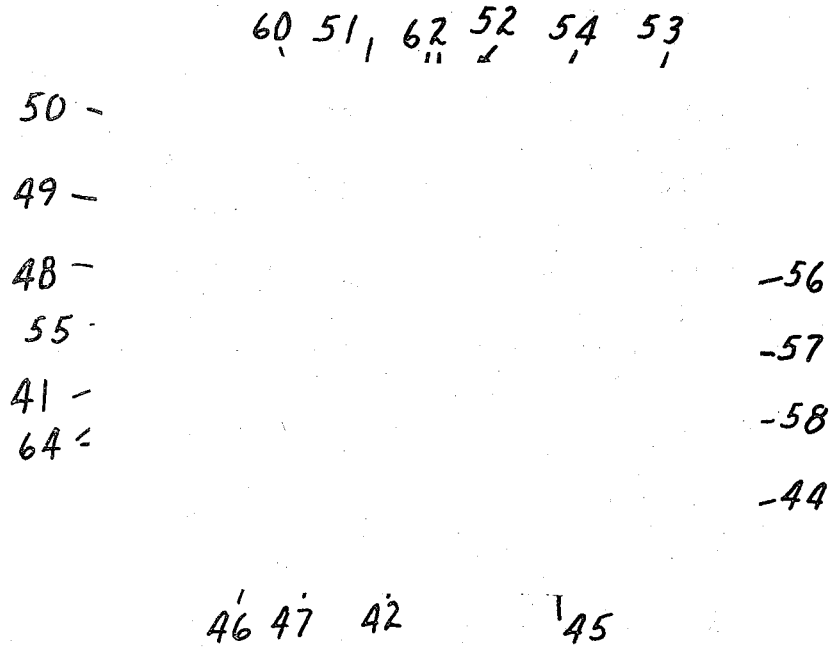
Fig.7 PRIOR ART
FIG. 7 is a scanning electron micrograph at a magnification of 1500X of a polished and etched section through an article prepared like the articles of FIGS. 1-6 but without the addition of elemental iron or nickel.
Figure 7:
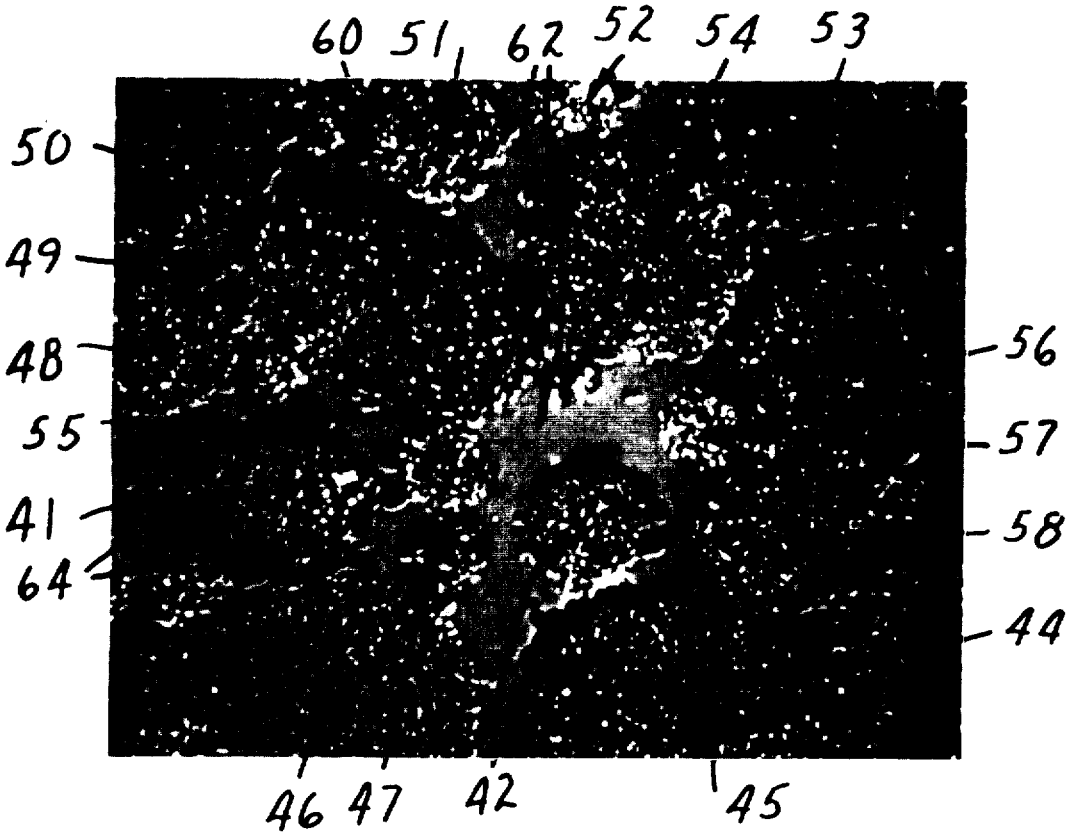
Fig.7 PRIOR ART

Referring now to FIGS. 5 and 6, there is shown an article of this invention prepared with an 11% addition of carbonyl nickel particles (based on the weight of spherical cobalt-containing particles). This article is the article of Example 9, below. The microstructure of FIGS. 5 and 6 has spherical domains, coating, a few interdomain necks, and infiltrant. The carbide particles 31 and 33 and spherical domains 35 correspond generally to those of FIGS. 1–4. The solid solution 37 principally contains cobalt, chromium, nickel, tungsten, and a small amount of iron. The coating 39 principally contains cobalt, chromium, nickel, and tungsten. As may be seen from an inspection of FIGS. 5 and 6, coating 39 has extensively enveloped spherical domains 35. Coating 39 is generally of greater thickness than the coatings of FIGS. 1–4, owing in part to the use of larger elemental particles to prepare the article of FIGS. 5 and 6 (i.e., the carbonyl nickel particles had an average diameter of 3–7 micrometers as measured by FISHER subsieve sizing, while the carbonyl iron particles had an average diameter of 3–5 micrometers as measured by micromerograph). Infiltrant 40 of FIGS. 5 and 6 has a generally homogeneous appearance.

Referring now to FIG. 7, there is shown an article of the prior art, prepared like the articles of FIGS. 1–6 but without elemental particle addition. The article of FIG. 7 is a comparison article in Example 1, below. There are both visual and chemical differences between the article of FIG. 7 and the articles of this invention. A few of the spherical domains shown in FIG. 7 have globular regions which are carbide-free at their perimeter (viz., spherical domains 41 and 42), but in the great majority of such spherical domains shown in FIG. 7, essentially no such carbide-free perimeter areas are shown (viz., spherical domains 44–58). In spherical domains 44–58 the light and dark colored carbide granules (not here numbered) extend to the very perimeter of the spherical domain. In such domains the carbide-bearing solid solution 60 is directly in contact with infiltrant 62. The carbide-bearing solid solution is not in contact with the infiltrant in only a few spherical domains (such as domains 41 and 42). Also, much more extensive interdomain neck growth can be seen in FIG. 7 than in FIGS. 1–6, and essentially no carbide-free, cobalt-containing solid solution can be seen between adjacent spherical domains in FIG. 7. Any carbide-free, cobalt-containing solid solution is in the form of the aforementioned globules, and such globular areas are found on only a small minority of the spherical domains shown in FIG. 7. Such globules, where found, usually only incompletely envelop spherical domains contiguous therewith.

Elemental analysis of one of the globular areas such as area 64 at the perimeter of spherical domain 41 shows a composition which is principally cobalt, chromium, iron, and tungsten in the approximate weight ratio 66:21:7:5.5. The iron present in such globule is derived from the original spherical cobalt-containing particles (in which there was about 2.69 percent by weight iron). Most of this iron resides in the carbide-bearing solid solution, which solid solution represents about one-half of the total particle weight. Elemental analysis of the solid solution 60 shows a composition containing the same principal elements in the approximate weight ratio 61:26:6.1:6.5. Thus, there was only about 15 percent more iron, 8 percent more cobalt, and 19 percent less chromium in the globular area than in the carbide-bearing solid solution of the spherical domains of FIG. 7.

In general, the articles of this invention can be characterized as containing spherical domains the majority of which are essentially fully coated with a carbide-free, cobalt-containing solid solution, such solid solution having, on a weight percentage basis, more iron, more cobalt, and less chromium than the percentage amounts of such elements within a carbide-bearing solid solution found within the interior of such spherical particles. The articles of this invention preferably contain, on a relative basis, at least 1.3 times the percentage level of iron or nickel found in such carbide-free solid solution, compared to the percentage level of iron or nickel found in such carbide-bearing solid solution. In the case of articles of this invention made with an elemental iron particle addition, the carbide-free solid solution preferably contains at least about 7 percent iron, and the carbide-bearing solid solution preferably contains at least about 6 percent iron. Most preferably, these two respective percentages are at least 13 percent and 10 percent, respectively.

The infiltrated metal articles of this invention are uniformly dense, tough, impact resistant and essentially free of internal and surface defects. They exhibit uniform physical, mechanical, and electrical properties, and their final size can be adjusted to compensate for dimensional change by adjusting the amount of elemental particle addition. Such articles are particularly useful for applications where tough articles having close dimensional tolerances are required, such as articles having intricate or complex shapes and surfaces with fine detail, e.g., dies for metal die casting and dies for plastic injection molding.

The following examples are offered to aid understanding of the present invention and are not to be construed as limiting the scope thereof. Unless otherwise specified, all parts are by weight.

EXAMPLE 1

One hundred parts of a less than 44 micrometer (−325 mesh U.S. Sieve) spherical cobalt-containing metal powder ("Stellite" Co-1 sold by Cabot Corp.) was mixed with 3 parts of carbon-bearing carbonyl iron powder ("TH", sold by GAF, Inc.) in a sigma blade mixer. The cobalt-containing spherical particles also contained, on a weight basis, 29.76 percent chromium, 13.37 percent tungsten, 2.69 percent iron, 2.05 percent carbon, 1.17 percent nickel, 0.27 percent silicon, 0.2 percent manganese, and less than 0.1 percent molybdenum. Sizing data for such spherical particles were as follows:

74–53 micrometers: 0.24%
53–44 micrometers: 0.13%
44–20 micrometers: 66.24%
20–10 micrometers: 24.42%
10–5 micrometers: 7.96%
<5 micrometers: 1.01%

The carbonyl iron particles were also spherical, and had an average particle diameter of 3–5 micrometers, as measured by micromerograph.

The powder mixture was combined with 4.18 parts of polyethylene glycol distearate ("Emerest" 2642, m.p. 36° C.) and the resulting metal powder-binder mixture was warmed to 66° C. The mixture contained 72.7 percent by volume cobalt-containing particles, 2.4 percent by volume carbon-bearing carbonyl iron powder, and 24.9 percent by volume binder.

The resulting plastic mass was transferred to a flexible mold in the shape of a trilevel block. The lowest level of the trilevel block was a rectangular base 51 mm long×38.07 mm wide×12.75 mm high. Centered above this base was a rectangular block 38.07 mm long×25.37 mm wide×12.74 mm high. Centered above this block was another rectangular block 25.37 mm long×12.67 mm wide×12.72 mm high. Five of the dimensions of this block (viz., the length and width of the top two blocks, and the length of the base) were used for subsequent dimensional comparison. A sixth dimension, the width of the base, was not so used because the master had not been machined squarely along this dimension. The mold was made from cured "RTV" silicone rubber containing 33 percent by weight glass beads having an average particle diameter less than 44 micrometers and had been heated to 66° C. prior to addition of the powder-binder mixture.

The mold and powder-binder mixture were evacuated to 3 Torr and maintained at 66° C. for 10 minutes, while being vibrated by an air-powered vibrator. The mold and its contents were then repressurized and transferred to an empty isothermal bath. The mold was vibrated for 4 minutes. Water at 38° C. was poured into the isothermal bath to a level 6 mm below the top of the mold. The mold was left in the bath for 60 minutes. The bath was drained and the mold then vibrated for 4 minutes. The air over the bath was heated to 21° C. for 90 minutes. The mold was cooled by adding 4° C. water to the bath, and the mold was then allowed to stand in the bath for 40 minutes at 4° C. The cooled mold and its contents were removed from the desiccator and the green article was immediately demolded using vacuum demolding and stored in a desiccator containing anhydrous calcium sulfate, and cooled to about 4° C. The green article was left in the desiccator for 24 hours.

The next day, the green article was placed in a graphite boat containing alumina powder ("Alcoa" grade—100—cooled to 4° C.) and vibrated slightly to lightly pack the non-reactive refractory powder around the green article. The boat and its contents were placed in a retort in an electric, computer-controlled Lindberg furnace, and the retort was slowly evacuated to prevent the alumina powder from scattering within the furnace. A vacuum of about 0.5 Torr was sufficient to remove most of the reactive gases and the furnace was rapidly backfilled with an atmosphere of argon containing 5% hydrogen. A dynamic gas atmosphere was maintained during the heating cycle at a flow rate of 170 liters/-hour. The furnace was heated from room temperature to 170° C. at a rate of 39.2° C. per hour; from 170° C. to 298° C. at a rate of 7.5° C. per hour; from 298° C. to 450° C. at a rate of 9° C. per hour; from 450° C. to 1050° C. at a rate of 100° C. per hour; and maintained at 1050° C. for 1 hour to degrade and remove the binder, allow the carbonyl iron particles to coat and diffuse into the spherical cobalt-containing particles, and permit the metal particles to coalesce into a handleable porous skeleton. Heating was discontinued and the boat and its contents were allowed to cool to 750° C. over a 3 hour period, and then from 750° C. to 150° C. over about an 8 hour period under the dynamic gas atmosphere in the furnace. The skeletal article was removed from the alumina bed and gently brushed with a camel hair brush to remove any surface adhering alumina.

The length and width of the top two blocks of the trilevel green molded shape and the length of the base of the trilevel green mold shape (a total of five dimensions) were compared to the corresponding dimensions of the trilevel skeletal preform. An average lineal shrinkage of 0.1% for the five comparisons was observed.

The preform was set on its base. A 3 mm wide band around the perimeter at the lowest exposed portion of the sides of the base was masked off with tape. The exposed surface of the preform was then sprayed with an aerosol suspension made up of 10 g of zirconia powder (about 1 to 5 m diameter) in 100 ml acetone. After removal of the masking tape, the skeletal preform was placed in an alumina bed located in a graphite boat. Three hundred seventy four grams (one-half the weight of the skeleton) of copper/tin powder was placed underneath the preform so that upon melting, the liquid copper/tin alloy would flow by capillary action into the bottom of the preform. The boat and its contents were placed in an electric furnace, and the furnace was evacuated to 0.05 Torr and backfilled with hydrogen. A dynamic hydrogen atmosphere was maintained at a flow rate of 28.3 liters/hour while the temperature was raised from room temperature to 1050° C. over a 2 hour period and maintained at that temperature for 1 hour. After infiltration, the furnace was shut off and the infiltrated article was cooled. The exterior zirconia coating was removed by peening it with less than 44 micrometer glass beads through an 8 mm orifice at 1.4 to 2.8 kg/cm$^2$ pressure.

The length and width of the top two blocks of the infiltrated trilevel block, and the length of the base of the infiltrated trilevel block (a total of 5 dimensions) were compared to the dimensions of the skeletal preform, and no change in dimension was measurable at a precision of $2.54\times10^{-3}$ mm (0.0001 in.). The shrinkage of the final infiltrated article compared to the original green shape remained at 0.1%. The peened article was sectioned, metallographically polished and etched, and, when optically examined at 1500X, the article appeared essentially homogeneous (i.e., the skeleton and infiltrant contained therein were randomly distributed) and no internal cracks, gross porosity, or other discontinuities were observed.

Three impact bars were molded according to the same procedure, and tested with a Rockwell C indenter. An average Rockwell C hardness of 41.3 was measured for the samples. The impact bar samples were then fractured in a Charpy impact tester. An average unnotched impact strength of 12.2 joules (9.0 ft./lbs.) was observed for the samples.

In a comparison run, a trilevel block and 3 impact bars were prepared using the above procedure but without any carbonyl powder addition. The powder loading of spherical cobalt-containing particles in binder was 74.3%, less than the 75.1% obtained above. The shrinkage of the fired skeletal article compared to the green molded article averaged 0.22%, a value greater than the 0.1% obtained above. Additional shrinkage of the comparison trilevel block occurred during infiltration, resulting in a total process shrinkage from green molded article to final infiltrated article of 0.23%, a value greater than the total process shrinkage of 0.1% obtained above. The average Rockwell hardness for impact bars prepared without carbonyl particle addition was 40.5, less than the 41.3 observed above. The Charpy unnotched impact for impact bars prepared without carbonyl particle addition was 8.54 joules (6.3 ft./lbs.), a value about 30 percent less than the value of 12.2 joules (9.0 ft./lbs.) observed above.

This example showed that a 3 weight percent addition of carbon-bearing carbonyl iron particles to spherical cobalt-containing particles resulted in higher particle loading of the metal powder mixture in binder, reduced shrinkage during sintering, and yielded a simultaneous increase in Rockwell hardness and unnotched impact strength.

EXAMPLES 2–9

Using the method of Example 1, varying levels of carbon-bearing carbonyl iron, carbon-free carbonyl iron, and carbonyl nickel were added to spherical cobalt-containing particles. Set out below in Table I for trilevel blocks prepared as described above are the level of carbonyl particle addition (expressed as weight percent compared to the total weight of spherical cobalt-containing particles), the total powder loading in binder, the dimensional change from green molded article to skeletal preform (with shrinkage being expressed as a negative number, and expansion being expressed as a positive number), and the dimensional change from the green molded article to the final infiltrated article (with shrinkage being expressed as a negative number, and expansion being expressed as a positive number). Also set out below in Table I are the Rockwell hardness and Charpy unnotched impact strength of impact bars containing the indicated carbonyl powder additions and prepared and tested as described above.

These examples show that as the level of elemental particle addition is increased, processing shrinkage is retarded. Sufficiently high levels of elemental particle addition caused slight process expansion. Impact strengths were substantially increased compared to articles made without elemental particle addition, while Rockwell hardness was essentially maintained or improved by such addition.

TABLE I

| Example No. | Carbonyl powder | Wt % carbonyl powder in powder mixture | Vol % powder mixture in binder | Dimensional change, green to preform, % | Dimensional change, green to infiltrated article, % | Impact bar hardness $R_c$ | Impact bar Charpy unnotched impact strength, joules (ft./lbs.) |
|---|---|---|---|---|---|---|---|
| 2 | TH | 7 | 76.9 | −.05 | −.05 | 40.0 | 12.9 (9.5) |
| 3 | TH | 11 | 78.1 | +.22 | +.22 | 38.8 | 13.8 (10.2) |
| 4 | HP | 3 | 75.1 | −.21 | −.08 | 37.5 | 9.4 (6.9) |
| 5 | HP | 7 | 76.9 | −.12 | −.04 | 37.7 | 8.9 (6.6) |
| 6 | HP | 11 | 78.1 | +.03 | +.16 | 31.7 | 14.1 (10.4) |
| 7 | 123 | 3 | 71.8 | −.11 | −.29 | 40.5 | 9.8 (7.2) |
| 8 | 123 | 7 | 72.3 | +.10 | +.04 | 41.0 | 9.2 (6.8) |
| 9 | 123 | 11 | 70.5 | +.48 | +.74 | 37.8 | 9.5 (7.0) |

Various modifications and alterations of this invention will be apparent to those skilled in the art without departing from the scope and spirit of this invention and the latter should not be restricted to that set forth herein for illustrative purposes.

What is claimed is:

1. A shaped, homogeneous, monolithic metal article, comprising:

A. a skeleton, comprising (i) a plurality of generally spherical domains having an average diameter less than about 200 micrometers, said domains, when viewed using backscattered electron imaging, comprising granules of chromium carbide homogeneously dispersed throughout a first solid solution comprising cobalt and chromium;

(ii) a second solid solution comprising cobalt and chromium, said second solid solution (a) containing a greater percentage of cobalt and a lesser percentage of chromium than said first solid solution, (b) being essentially free of carbides, and (c) enveloping the majority of said spherical domains, the so-enveloped domains and second solid solution being interconnected to form said skeleton; and (iii) iron or nickel as an additional component of said first and second solid solutions; and B. infiltrant, comprising a continuous phase of metal or alloy occupying the volume of said article not occupied by said skeleton; said skeleton and said infiltrant thereby comprising two intermeshed matrices and said article being substantially void-free.

2. An article according to claim 1, further comprising granules of tungsten carbide homogeneously dispersed throughout said first solid solution.

3. An article according to claim 1, wherein the total content of iron and nickel in said second solid solution is greater than the total content of iron and nickel in said first solid solution.

4. An article according to claim 3, wherein the percentage content of iron plus nickel in said second solid solution is 1.3 or more times as great as the percentage content of iron plus nickel in said first solid solution.

5. An article according to claim 1, wherein said second solid solution comprises cobalt, chromium, iron, and carbon.

6. An article according to claim 5, wherein said first solid solution contains about 6% or more iron, and said second solid solution contains about 7% or more iron.

7. An article according to claim 5, wherein said first solid solution contains about 10% or more iron, and said second solid solution contains about 13% or more iron.

8. An article according to claim 1, wherein said spherical domains have an average diameter between about 1 and about 44 micrometers.

9. An article according to claim 1, wherein the portions of said second solid solution enveloping individual spherical domains have an average thickness, measured radially outward from the center of such spherical domains, of 5 micrometers or less.

10. A shaped, homogeneous, monolithic metal article, comprising:

A. a skeleton, comprising (i) a plurality of generally spherical domains having an average diameter between about 1 and about 44 micrometers, said domains, when viewed using backscattered electron imaging, comprising granules of chromium carbide and granules of tungsten carbide homogeneously dispersed throughout a first solid solution comprising cobalt, chromium, and at least 6% by weight iron;

(ii) a second solid solution comprising cobalt, chromium, and at least 7.8% by weight iron, said second solid solution (a) containing a greater percentage of cobalt and a lesser percentage of chromium than said first solid solution, (b) being essentially free of carbides, and (c) enveloping the majority of said spherical domains, with the portions of said second solid solution enveloping individual spherical domains having an average thickness, measured radially outward from the center of such spherical particles, of 5 micrometers or less, and with the so-enveloped domains and second solid solution being interconnected to form said skeleton; and B. infiltrant, comprising a continuous phase of copper/tin alloy occupying the volume of said article not occupied by said skeleton; said skeleton and said infiltrant thereby comprising two intermeshed matrices and said article being substantially void-free.

11. A die cavity according to claim 10.

12. In a process for making infiltrated molded metal articles by molding in a flexible mold of a master a plastic mixture of spherical cobalt-containing powder and heat fugitive binder comprising thermoplastic material to form a green article of predetermined shape and dimensions, removing said green article from said mold, heating said green article to remove said binder and consolidate said spherical cobalt-containing powder in the form of a porous, monolithic skeleton of particles of cobalt-containing metal, infiltrating said skeleton with a molten metal having a melting point that is at least 25° C. less than the melting point of the lowest melting of said cobalt-containing metal particles, and cooling the infiltrated skeleton, the improvement comprising adding to said spherical cobalt-containing powder up to about 11% by weight, based on the weight of said spherical cobalt-containing powder, of elemental iron or elemental nickel particles having an average particle diameter less than about 10 micrometers.

13. A process according to claim 12, wherein said elemental iron is carbonyl iron or said elemental nickel is carbonyl nickel.

14. A process according to claim 12, wherein said particles of cobalt-containing metal have an average particle diameter between about 1 and about 44 micrometers, said elemental particles are carbon-bearing carbonyl iron particles having an average particle diameter between about 3 and about 5 micrometers, and said article is a die cavity.

* * * * *

UNITED STATES PATENT AND TRADEMARK OFFICE

CERTIFICATE OF CORRECTION

PATENT NO. : 4,455,354

DATED : June 19, 1984

INVENTOR(S) : Kenneth R. Dillon and Richard L. Terchek

It is certified that error appears in the above-identified patent and that said Letters Patent is hereby corrected as shown below:

In the drawing, at sheet 4, Fig. 7 should appear as shown in the attached sheet.

Signed and Sealed this

*Tenth* Day of *September 1985*

[SEAL]

*Attest:*

DONALD J. QUIGG

*Attesting Officer* *Acting Commissioner of Patents and Trademarks - Designate*